US008407839B2

(12) United States Patent
Crookston

(10) Patent No.: US 8,407,839 B2
(45) Date of Patent: Apr. 2, 2013

(54) ROOFING TOOL

(75) Inventor: Matthew J. Crookston, Stow, OH (US)

(73) Assignee: AJC Tools & Equipment, Hudson, OH (US)

( * ) Notice: Subject to any disclaimer, the term of this patent is extended or adjusted under 35 U.S.C. 154(b) by 345 days.

(21) Appl. No.: 12/717,374

(22) Filed: Mar. 4, 2010

(65) Prior Publication Data

US 2010/0223735 A1 Sep. 9, 2010

Related U.S. Application Data

(60) Provisional application No. 61/157,242, filed on Mar. 4, 2009.

(51) Int. Cl.

| | |
|---|---|
| ***B26B 11/00*** | (2006.01) |
| ***B26B 1/00*** | (2006.01) |
| ***B26B 3/00*** | (2006.01) |
| ***B25F 5/02*** | (2006.01) |
| ***B25F 3/00*** | (2006.01) |
| ***B44C 7/00*** | (2006.01) |
| ***B05C 1/08*** | (2006.01) |
| ***F16C 13/00*** | (2006.01) |
| ***E04D 15/00*** | (2006.01) |

(52) U.S. Cl. ..... 7/170; 7/161; 7/167; 7/158; 7/105; 492/13; 492/19; 492/15; 29/243.5; 81/45; 30/125

(58) Field of Classification Search ..... 7/105, 158, 7/170; 492/13
See application file for complete search history.

(56) References Cited

U.S. PATENT DOCUMENTS

| | | | | |
|---|---|---|---|---|
| 3,456,737 | A * | 7/1969 | Rhyme | 172/381 |
| 4,894,112 | A | 1/1990 | Lippman | |
| 5,393,289 | A | 2/1995 | Green | |
| D498,397 | S | 11/2004 | Mitchell | |
| 6,875,162 | B2 | 4/2005 | Barksdale et al. | |
| D552,952 | S | 10/2007 | Horner et al. | |
| D556,526 | S | 12/2007 | Horner et al. | |
| 7,588,523 | B2 * | 9/2009 | Horner et al. | 492/13 |
| 2007/0143946 | A1 * | 6/2007 | Kim | 15/230.11 |

OTHER PUBLICATIONS

Everhard Products, Inc., Roll-n-Chek Seam Roller; catalog page, 2008.

Everhard Products, Inc., Inspector's Seam Tester, catalog page, 2008.

* cited by examiner

*Primary Examiner* — Monica Carter
*Assistant Examiner* — Danny Hong
(74) *Attorney, Agent, or Firm* — Hahn Loeser & Parks LLP

(57) ABSTRACT

A roofing tool comprises a handle with a longitudinal axis and a longitudinal shaft coaxial therewith, the handle having a first end and a second end, a hollow shaft having a first end and a second end, the first end of the hollow shaft being axially inserted into the second end of the handle and the second end of the hollow shaft extending therefrom, a bracket attached to the second end of the hollow shaft, a roller rotatably attached to the bracket, a seam tester member having a tapered pick end and an elongated shaft disposed within the hollow shaft; and a detent member secured to the handle and configured to detain the seam tester member within the handle.

20 Claims, 6 Drawing Sheets

ROOFING TOOL

CROSS-REFERENCE TO RELATED APPLICATIONS

This application claims priority from and the benefit of U.S. Provisional Application Ser. No. 61/157,242, filed on Mar. 4, 2009. The disclosure of that application is incorporated in its entirety by reference herein.

TECHNICAL FIELD

The subject invention relates to a roofing tool, and more particularly, to a compound tool comprising a seam roller and a seam tester.

BACKGROUND OF THE INVENTION

Pliable sheets of sealable materials are commonly used in many industrial, environmental and civil construction applications, particularly within the roofing industry. One method for sealing and/or joining such sealable materials in the roofing industry may be heat sealing. Typically, in a roofing application, large sheets of materials may be placed on the roof with their edges overlapping. For instance, a single-ply thermo-plastic sheet may often be utilized as a roofing membrane to prevent leakage of water through a roof. When using adhesive/bond or self-adhesive seals, the overlapping edges may be press-welded to one another. When using thermoplastic materials, the overlapping edges may be heat welded to one another along or within the overlapping region. The heat sealing process may be performed manually by an individual who may separate the overlapping edges along the overlap and then may heat the separated edges, e.g., by directing hot air between the separated edges with a blow gun or hot air device. When heated sufficiently, the surfaces of the separated edges liquefy. The edges may then be pressed together to provide a seam or tack-weld between the overlapping edges, which seals the sheets together upon cooling. Typically a moveable compressing means, such as a hand roller, may be used to improve the quality of the seam by driving air bubbles out of the molten material and increasing the contact between the molten edges.

Once a seam has been formed between two membranes, the quality of the seam may be inspected using a seam tester, which is typically a tool separate from a seam roller. A typical seam tester may be L-shaped and may have a tapered, pointed tip, although it is not unknown for a seam tester to be relatively straight and taper to a point. After sealing two membranes together, the seam may be tested by attempting to insert the tip of the seam tester between the two membranes. In the event of a complete seam between the membranes, the tip of the seam tester will not slide between the now-sealed membranes. In contrast, if the tip of the seam tester does in fact slide between the membranes, the seam is not complete and the membranes must be reheated and sealed again.

Among the attempts at solving the problem of having a separate seam roller and seam tester are the apparatuses disclosed in U.S. Pat. Nos. D552,952 and D556,526, to Horner et al. This design is impractical in use, however, as individuals using such tools must repeatedly rotate the tool to perform either the seam rolling or seam testing function. As such, there is a likelihood that the tool may be dropped any time a user's grip on the tool is released, thereby reducing the efficiency of the seam rolling/testing process.

Furthermore, individuals using seam rollers typically store their tools in the rear pocket of their pants when the roller is not in use. The prior art designs encounter two difficulties in this regard. First, if the roller end of the prior art designs is inserted into a user's back pocket, the seam tester extends upward from the pocket and causes potential difficulty when an individual sits down, i.e. the seam tester may poke the individual in the back or damage the seat being sat upon. Secondly, the roller end of the prior art tools is significantly more massive than the seam tester end; if the seam tester end is placed in a user's back pocket, the tool has a tendency to fall out based on the relatively larger mass of the roller extending outside of the pocket.

Therefore, there exists in the art a need for a roofing tool, which may be stored in a user's rear pants pocket during periods of non-use, which allows a user to apply pressure to form a seam between sealable membranes and which also allows a user check the quality of such seams without releasing the tool or utilizing a separate tool to perform the seam forming and seam quality test functions.

SUMMARY OF THE INVENTION

Presently disclosed is a roofing tool which comprises a handle with a longitudinal axis with a longitudinal shaft coaxial therewith, the handle having a first end and a second end. The tool also comprises a hollow shaft having a first end and a second end, where the first end of the hollow shaft is axially inserted into the longitudinal shaft at the second end of the handle and the second end of the hollow shaft extends therefrom. A bracket is attached to the second end of the hollow shaft, and a roller is rotatably attached to the bracket. The tool further comprises a seam tester member having a tapered pick end and an elongated shaft disposed within the hollow shaft. A detent member is secured to the handle and configured to detain the seam tester member within the handle.

Alternatively or additionally, where the seam tester member may selectively extensible and retractable within the handle, and the seam tester member may be selectively rotatable within the handle. The seam tester member may be selectively removable from the handle. Furthermore, the pick end of the seam tester member may be formed at an angle of about 90° relative to the elongated shaft.

The portion of the seam tester member located within the handle may include a retaining member. In one instance, the retaining member may be a ball spring.

Alternatively or additionally, the roller may include a central core and a sleeve enveloping the central core. The sleeve may be formed from an elastomeric material.

Also disclosed is a roofing tool which comprises a handle with a longitudinal axis and a longitudinal shaft coaxial therewith, the handle having a first end and a second end. The tool also comprises a hollow shaft having a first end and a second end, where the first end of the hollow shaft is axially inserted into the longitudinal shaft at the second end of the handle and the second end of the hollow shaft extends therefrom. A bracket is attached to the second end of the hollow shaft, and a roller is rotatably attached to the bracket. The tool further comprises a seam tester member having a tapered pick end and an elongated shaft disposed within the hollow shaft. A detent member is secured to the hollow shaft and configured to detain the seam tester member within the hollow shaft.

In a further embodiment, a roofing tool comprises a handle with a longitudinal axis and a longitudinal shaft coaxial therewith, the handle having a first end and a second end. The tool also comprises a first hollow shaft having a first end and a second end, where the first end of the first hollow shaft is axially inserted into the longitudinal shaft at the first end of the handle and the second end of the first hollow shaft extending therefrom. A first bracket is attached to the second end of the first hollow shaft, and a first roller is rotatably attached to the first bracket. In addition, the tool comprises a second hollow shaft having a first end and a second end, where the first end of the second hollow shaft is axially inserted into the longitudinal shaft at the second end of the handle and the second end of the second hollow shaft extends therefrom. A second bracket is attached to the second end of the second hollow shaft, and a second roller is rotatably attached to the second bracket. The tool further comprises a seam tester member having a tapered pick end and an elongated shaft selectively receivable within at least one of the first hollow shaft and the second hollow shaft. A first detent member is secured to the first end of the handle and configured to detain the seam tester member within the first hollow shaft, and a second detent member is secured to the second end of the handle and configured to detain the seam tester member within the second hollow shaft.

Alternatively or additionally, the first roller may be formed from at least a first material and the second roller may be formed from at least a second material. The first material may be brass and the second roller may include a central core and a sleeve enveloping the central core.

DETAILED DESCRIPTION

Figure 1:
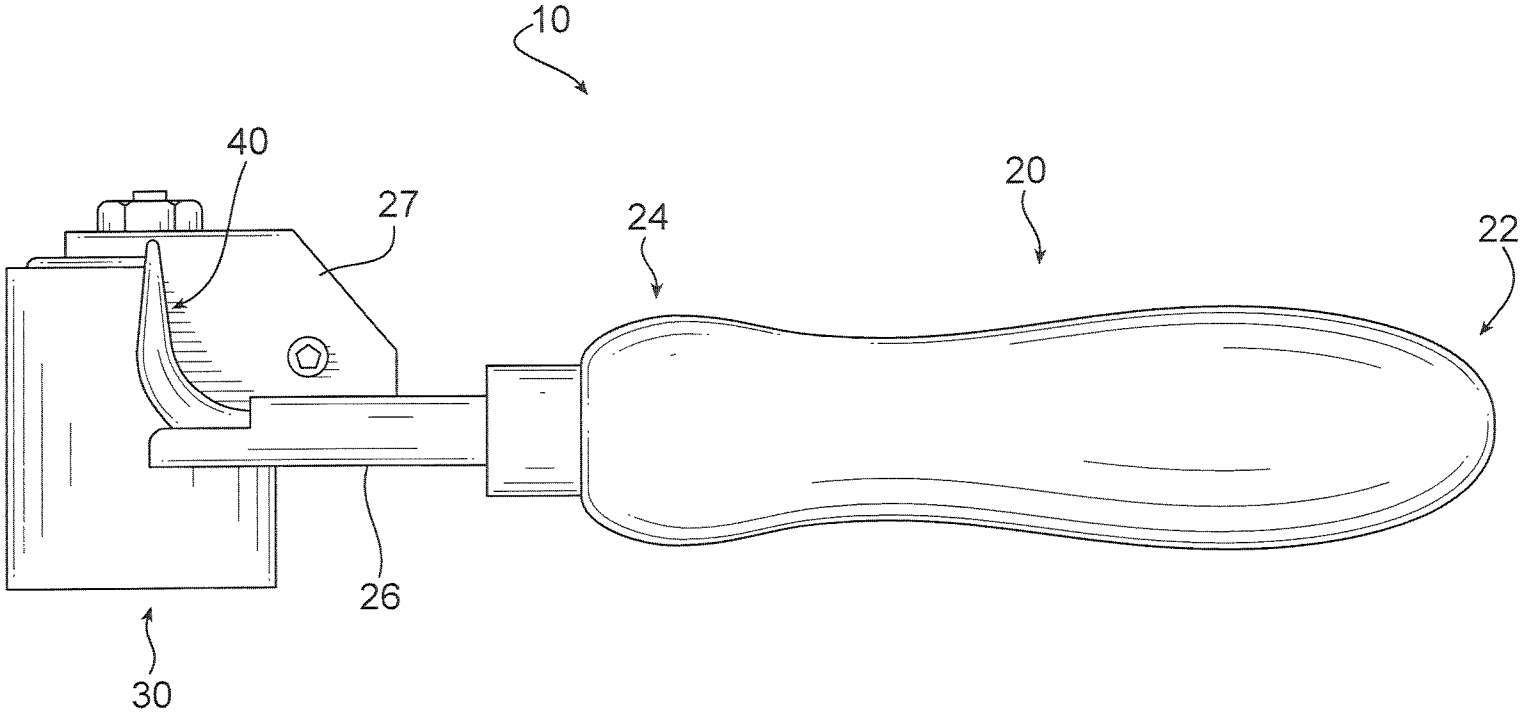
FIG. 1 shows a top plan view of a roofing tool, in accordance with one embodiment of the subject invention.

An embodiment of a roofing tool, generally identified by reference numeral 10, is illustrated in the Figures. As shown generally in FIGS. 1-5, a roofing tool 10 may comprise a handle 20, a roller 30, and a seam tester 40. The roofing tool 10 may be used to both assist in joining roofing membranes together by application of rolling pressure and for subsequently testing the seam formed between the joined roofing membranes The handle 20 may be generally cylindrical in shape having a longitudinal axis and a longitudinal shaft 25 coaxial with the longitudinal axis. The handle 20 may be designed so as to fit comfortably within the hand of a user during periods of extended use. For example, the handle 20 may taper along its length from a larger diameter at the first end 22 of the handle to a smaller diameter at an intermediate position along the length of the handle and then back to a larger diameter at the second end of the handle 24, as shown in FIG. 1. To further aid a user's grip, the handle 20 may additionally include a series of depressions wherein a user may place his fingers. In construction, the handle 20 may be made of any suitable material for production of hand tool handles, for example wood or thermoplastic materials. So as to cushion the grip, it is also envisioned that the handle 20 may be covered with a rubber or foam sleeve, for example.

Figure 2:
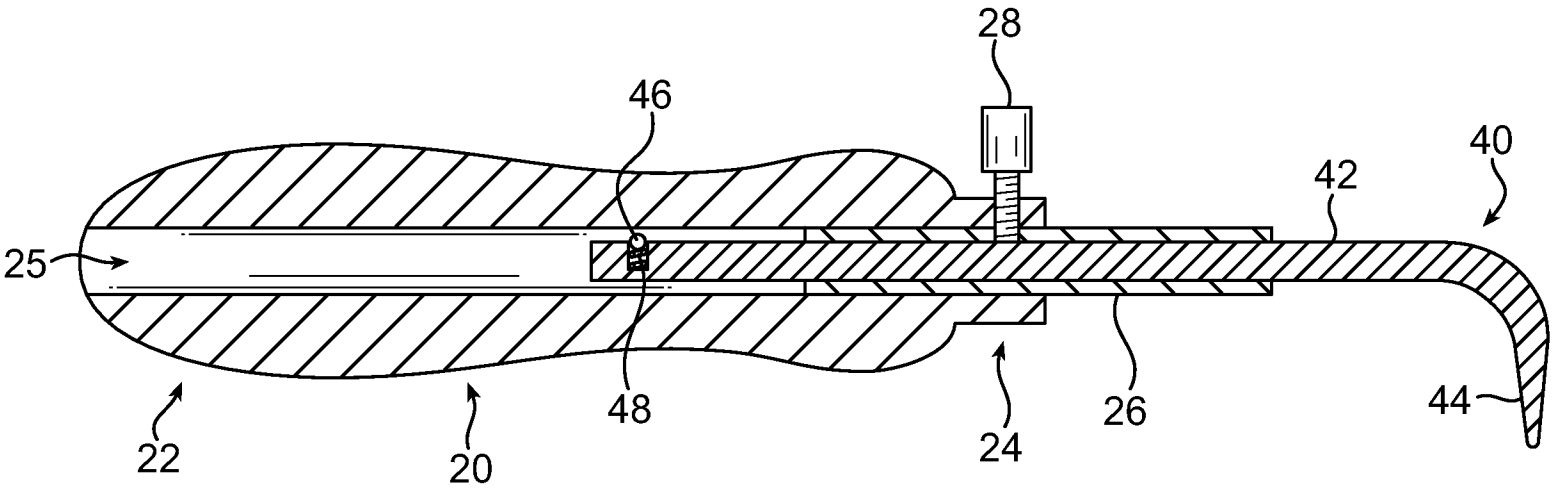
FIG. 2 shows a cross-sectional view of the roofing tool of FIG. 1, with the bracket and roller removed for clarity.
Figure 3:
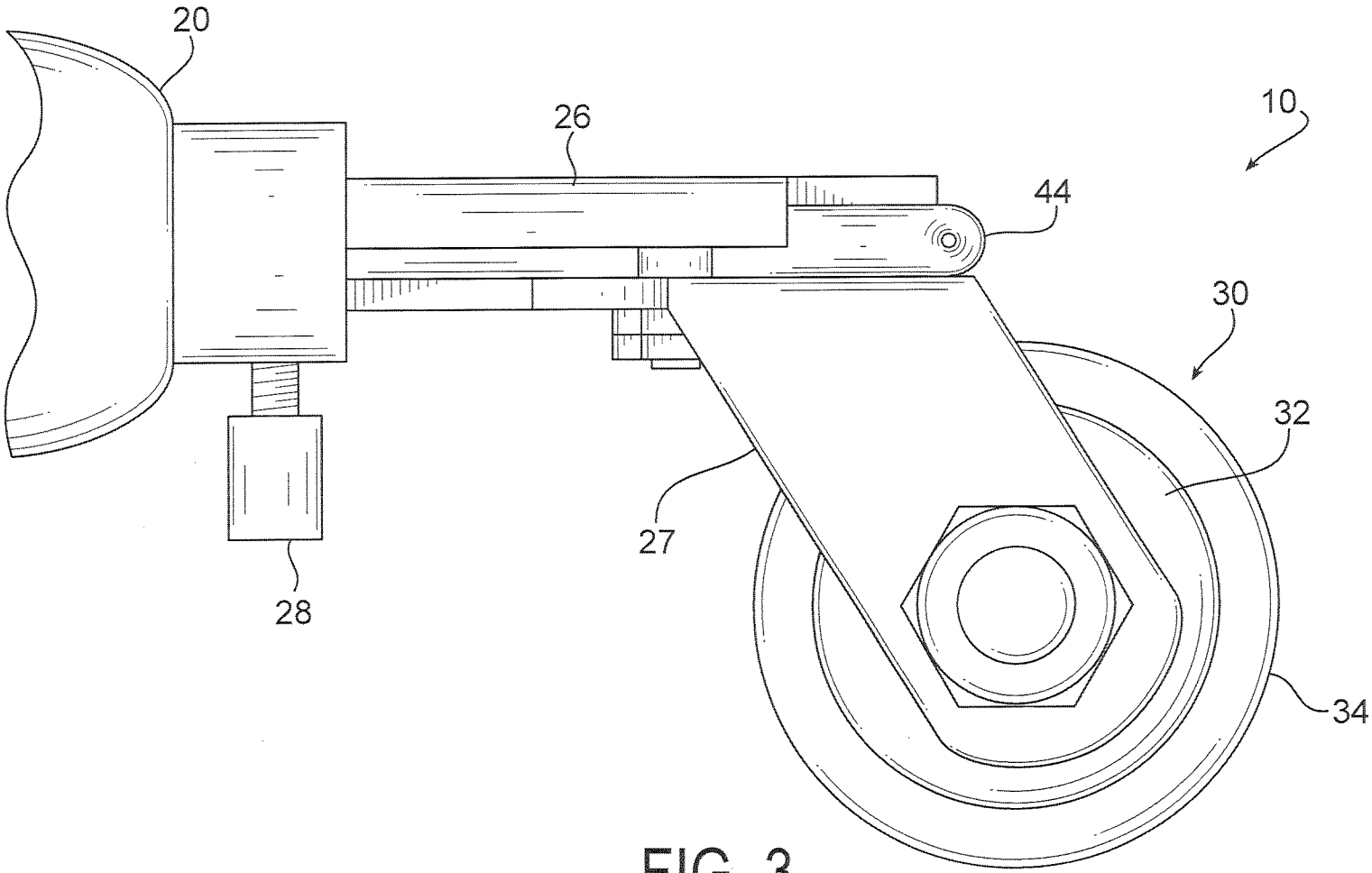
FIG. 3 shows a side view of the roofing tool of FIG. 1.
Figure 4:
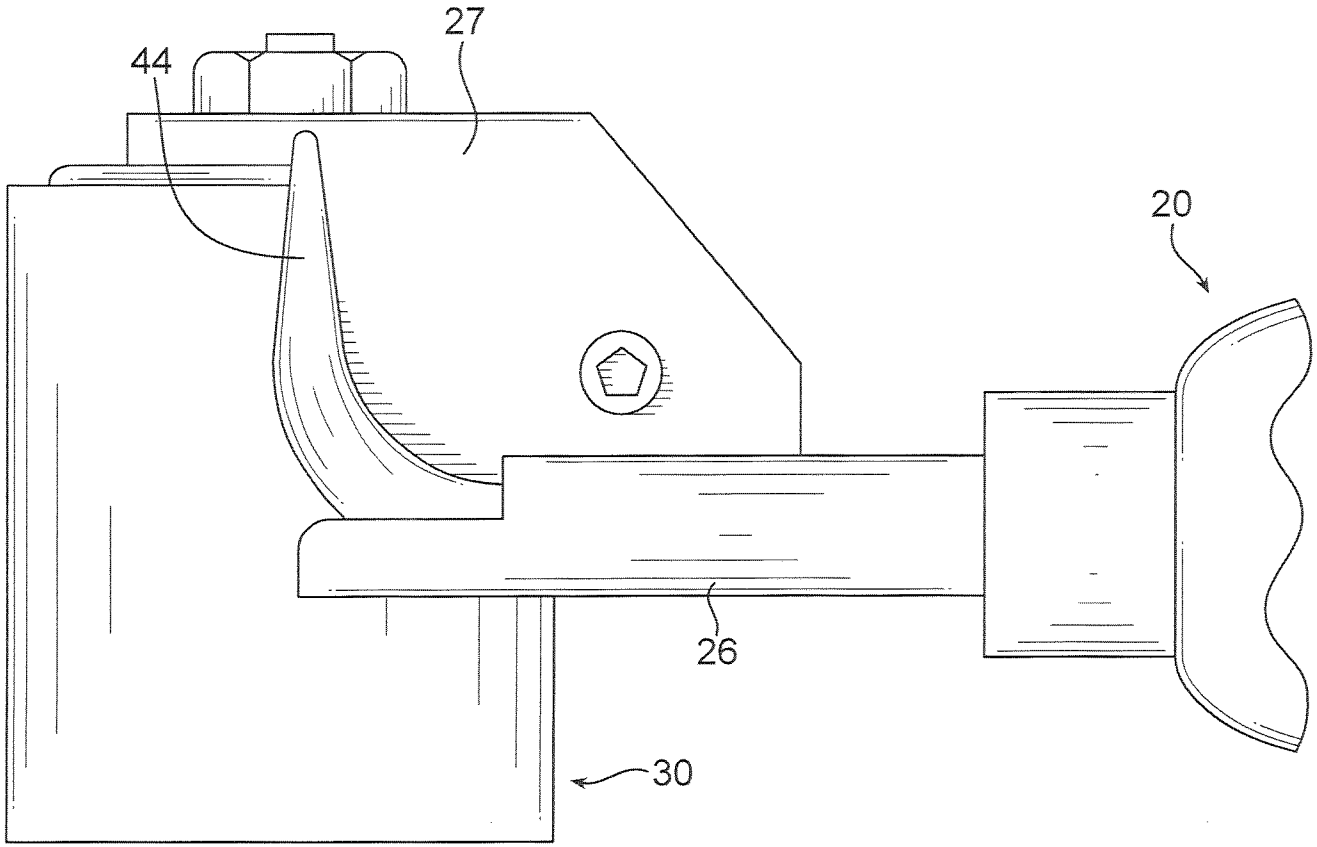
FIG. 4 shows a top plan view of the roofing tool of FIG. 1.

Referring now to FIG. 2, a first end of a hollow shaft 26 may be press-fit or similarly inserted axially into the longitudinal shaft 25 at the second end of the handle 24, such that a second end of the hollow shaft 26 may also extend axially outward from the second end of the handle 24. As best shown in FIGS. 3 and 4, an angled bracket 27 may attached to the portion of the hollow shaft 26 extending from the handle 20. A roller 30 may be rotatably attached to the bracket 27 such that the rotational axis of the roller 30 is perpendicular to the longitudinal axis of the handle 20.

In construction, the roller 30 may be a cylinder comprising silicone or another elastomeric material, although it is alternatively envisioned that the roller 30 may comprise wood or a metal, such as steel or brass. As shown in FIG. 3, in one embodiment the roller 30 may include a central core 32 surrounded by a sleeve 34, which may frictionally engage the core 32 or may be adhered thereto. In one example, the central core 32 may be steel and the sleeve 34 may be silicone. In use, a user grasps the handle 20 of the tool and engages the surface of the roller 30 with the material to be sealed, applying a pressure sufficient to drive air bubbles from the seam and to create a uniform, flat seam.

Figure 5:
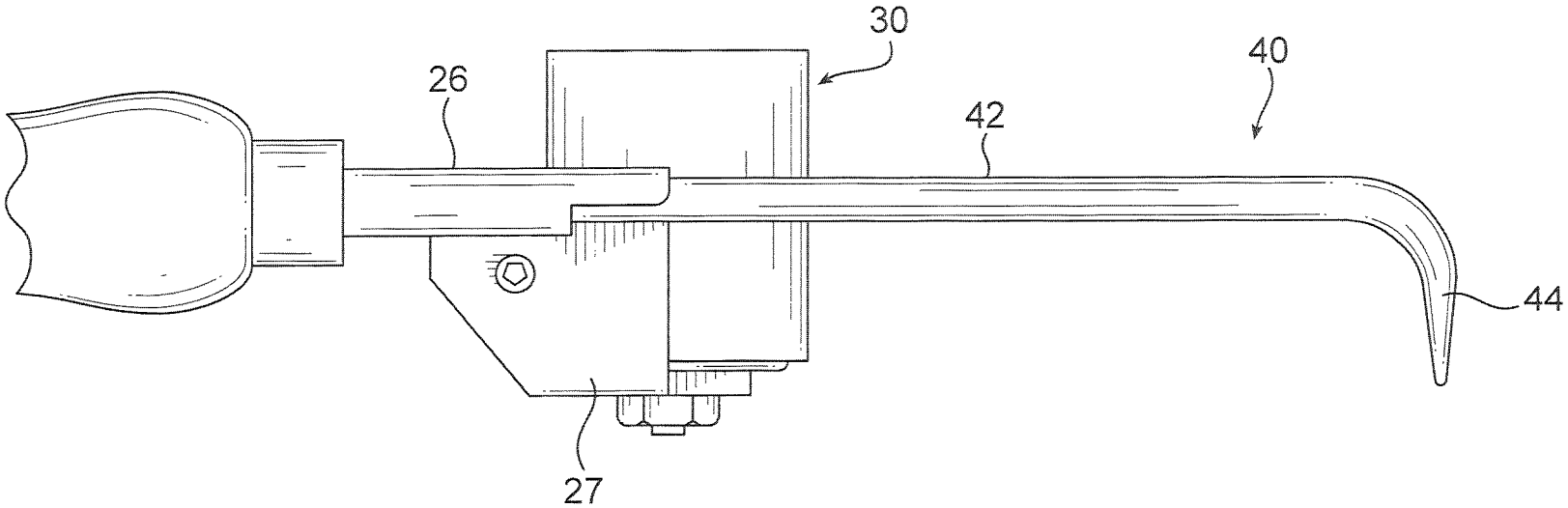
FIG. 5 shows a top plan view of the roofing tool of FIG. 1. having an extended seam tester.

Referring now to FIGS. 2 and 5, the roofing tool 10 may also comprise a seam tester 40 which in one embodiment may be L-shaped. The seam tester 40 may include a substantially straight, elongated shaft 42 terminating in a tapered pick end 44 formed at approximately 90° to the elongated shaft, although alternatively the seam tester may include a straight shaft tapering to a point. In assembly, the elongated shaft 42 may be inserted into hollow shaft 26 which may be coaxial with the longitudinal handle shaft 25. The elongated shaft 42, the hollow shaft 26, and the longitudinal handle shaft 25 may be circular in radial cross-section. As such, the seam tester 40 may be rotated radially within shafts 25, 26 to position the pick end 44 at a desired orientation with respect to the orientation of the roller 30.

Upon insertion into the hollow shaft 26, the seam tester member 40 may be selectively retained having a desired extension/retraction by a detent mechanism 28. Additionally, the pick end 44 may be retained in the desired orientation with respect to the roller 30. The detent mechanism 28 may be secured to the handle 24 in a manner such that the mechanism 28 passes through the handle and the hollow shaft 26 and contacts the elongated shaft 42, whereby the pressure exerted by the detent mechanism retains the seam tester member 40 at the desired orientation. Alternatively, the detent mechanism 28 may be secured to the hollow shaft 26 alone, without first passing through the handle 24, while still configured to detain the seam tester member 40 at the desired orientation and extension. In one embodiment, it is envisioned that the detent mechanism 28 may be a thumb screw. It is also envisioned that the detent mechanism 28 may be digitally actuated such that a user need not release or re-grip the tool 10 or use a second hand to extend and/or retract the tester 40. For example, a standard finger or thumb slide known to one having ordinary skill in the art may be used to selectively extend and retract the tester 40.

To diminish the likelihood that the seam tester member 40 might become removed entirely from the roofing tool 10, a retention member 46 may be located on the elongated shaft 42. For example, a ball spring 48 may be located on the elongated shaft 42. As such, the roofing tool 10 may be inverted with the seam tester member 40 pointing downward and the detent mechanism 28 disengaged without the seam tester member falling out of the roofing tool. However, a user desiring to remove the seam tester member 40 from the roofing tool 10 for replacement or other purposes may be able to overcome the force exerted by the retention member 46 and manually pull the seam tester member from the roofing tool. At this point, the same seam tester member 40 may be reinserted into the hollow shaft 26, or another Alternatively, the end of the elongated shaft 42 may be deformed such that once inserted into the shafts 25, 26, the elongated shaft may not be removed from the roofing tool 10.

Once a user has sealed two membranes together, the detent mechanism 28 may be disengaged and the seam tester member 40 may be selectively extended from the hollow shaft 26 to test the quality of the seam. It is also envisioned that the extended tester 40 may be used to apply pressure to seams in locations which a seam roller may not be able to reach completely, for example in inside corners. Once the tester 40 has been used to verify the quality of a seam, the user may subsequently retract the tester 40 into the hollow shaft 26 and re-engage the detent mechanism 28. Thereafter, the user may continue using the roller 30 to apply pressure in order to form seams without interference from the formerly-extended tester 40.

Figure 6:
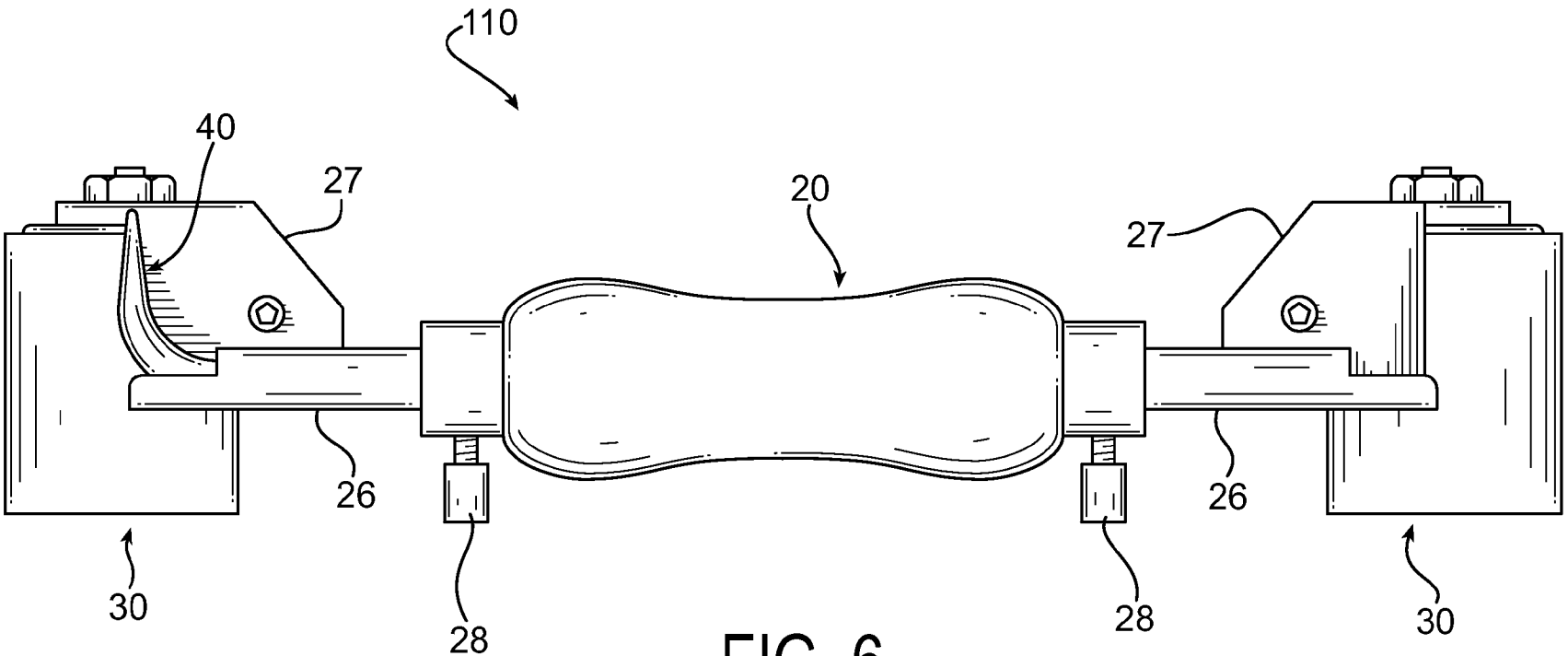
FIG. 6 shows a top plan view of another embodiment of a roofing tool.

In a further embodiment of a roofing tool 100 shown in FIG. 6, it is also envisioned that a hollow shaft 26, bracket 27, and roller 30 may be attached to each end of the handle 20. A first detent member 28 is secured to the first end of the handle and configured to detain the seam tester member within the first hollow shaft, and a second detent member 28 is secured to the second end of the handle and configured to detain the seam tester member within the second hollow shaft. The roller 30 on one end of the handle 20 may have a silicone surface for one material application, while the roller 30 on the other end of the handle may have a brass surface for a further material application. As such, the seam tester member 40 may be selectively inserted into and received by the hollow shaft 26 at either end of the tool, depending upon the particular material being joined. Such a configuration permits a user to carry one roofing tool for use in fabricating various types of roofing materials.

The foregoing description of the preferred embodiments is by way of example only, and other variations of the above described embodiments are provided by the subject disclosure. The embodiments presented herein have been presented for purposes of illustration and are not intended to be exhaustive or limiting. Many variations and modifications are possible in light of the foregoing teaching.

What is claimed is:

1. A roofing tool comprising:

a handle with a longitudinal axis and a longitudinal shaft coaxial therewith, the handle having a first end and a second end;

a hollow shaft having a first end and a second end, the first end of the hollow shaft being axially inserted into the longitudinal shaft at the second end of the handle and the second end of the hollow shaft extending therefrom;

a bracket attached to the second end of the hollow shaft;

a roller rotatably attached to the bracket;

a seam tester member having a tapered pick end and an elongated shaft disposed within the second end of the handle; and a detent member secured to the handle and configured to detain the seam tester member within the handle.

2. The roofing tool of claim 1, where the seam tester member is selectively extensible and retractable within the handle.

3. The roofing tool of claim 1, where the seam tester member is selectively rotatable within the handle.

4. The roofing tool of claim 1, where the portion of the seam tester member disposed within the handle includes a retaining member.

5. The roofing tool of claim 4, where the retaining member is a ball spring.

6. The roofing tool of claim 1, where the roller includes a central core and a sleeve enveloping the central core.

7. The roofing tool of claim 6, where the sleeve is formed from an elastomeric material.

8. The roofing tool of claim 1, where the seam tester member is selectively removable from the handle.

9. The roofing tool of claim 1, where the pick end of the seam tester member is formed at an angle of about 90° relative to the elongated shaft.

10. A roofing tool comprising:

a handle with a longitudinal axis and a longitudinal shaft coaxial therewith, the handle having a first end and a second end;

a hollow shaft having a first end and a second end, the first end of the hollow shaft being axially inserted into the longitudinal shaft at the second end of the handle and the second end of the hollow shaft extending therefrom;

a bracket attached to the second end of the hollow shaft;

a roller rotatably attached to the bracket;

a seam tester member having a tapered pick end and an elongated shaft disposed within the second end of the hollow shaft; and a detent member secured to the hollow shaft and configured to detain the seam tester member within the hollow shaft.

11. The roofing tool of claim 10, where the seam tester member is selectively extensible and retractable within the hollow shaft.

12. The roofing tool of claim 11, where the seam tester member is selectively rotatable within the hollow shaft.

13. The roofing tool of claim 10, where the roller includes a central core and a sleeve enveloping the central core.

14. The roofing tool of claim 13, where the sleeve is formed from an elastomeric material.

15. The roofing tool of claim 10, where the pick end of the seam tester member is formed at an angle of about 90° relative to the elongated shaft.

16. The roofing tool of claim 10, where the portion of the seam tester member disposed within the hollow shaft includes a retaining member.

17. The roofing tool of claim 16, where the retaining member is a ball spring.

18. A roofing tool comprising:

a handle with a longitudinal axis and a longitudinal shaft coaxial therewith, the handle having a first end and a second end;

a first hollow shaft having a first end and a second end, the first end of the first hollow shaft being axially inserted into the longitudinal shaft at the first end of the handle and the second end of the first hollow shaft extending therefrom;

a first bracket attached to the second end of the first hollow shaft;

a first roller rotatably attached to the first bracket;

a second hollow shaft having a first end and a second end, the first end of the second hollow shaft being axially inserted into the longitudinal shaft at the second end of the handle and the second end of the second hollow shaft extending therefrom;

a second bracket attached to the second end of the second hollow shaft;

a second roller rotatably attached to the second bracket;

a seam tester member having a tapered pick end and an elongated shaft selectively receivable within the second end of each of the first hollow shaft and the second hollow shaft;

a first detent member secured to the first end of the handle and configured to detain the seam tester member within the first hollow shaft; and a second detent member secured to the second end of the handle and configured to detain the seam tester member within the second hollow shaft.

19. The roofing tool of claim 18, where the first roller is formed from at least a first material and the second roller is formed from at least a second material.

20. The roofing tool of claim 19, where the first material is brass and the second roller includes a central core and a sleeve enveloping the central core.

* * * * *